US005878700A

United States Patent [19]

Farzan et al.

[11] Patent Number: 5,878,700

[45] Date of Patent: Mar. 9, 1999

[54] INTEGRATED REBURN SYSTEM FOR $NO_X$ CONTROL FROM CYCLONE-FIRED BOILERS

[75] Inventors: Hamid Farzan, Jackson Township; Gerald J. Maringo, Canton, both of Ohio

[73] Assignees: The Babcock & Wilcox Company; McDermott Technology, Inc., both of New Orleans, La.

[21] Appl. No.: 975,725

[22] Filed: Nov. 21, 1997

[51] Int. Cl.[6] ..... B09B 3/00

[52] U.S. Cl. ..... 122/4 D; 122/247; 110/345

[58] Field of Search ..... 122/4 D, 247; 110/260, 261, 262, 263, 264, 265, 345, 347

[56] References Cited

U.S. PATENT DOCUMENTS

| | | | |
|---|---|---|---|
| 4,765,258 | 8/1988 | Zauderer | 110/347 |
| 5,022,329 | 6/1991 | Rackley et al. | 110/234 |
| 5,052,312 | 10/1991 | Rackley et al. | 110/264 |
| 5,193,490 | 3/1993 | Persuski | 110/265 |
| 5,549,059 | 8/1996 | Nechvatal et al. | 110/346 |
| 5,572,956 | 11/1996 | Hallstrom et al. | 122/247 |
| 5,765,488 | 6/1998 | Vatsky | 110/265 |

OTHER PUBLICATIONS

Czuczwa, J.M. et al., The Babcock & Wilcox Company Technical Paper No. RDTPA 91–13, "Cyclone Furnace for Vitrification of Contaminated Soil and Wastes", presented at the 1991 Incineration Conference, Knoxville, TN, May 13–17, 1991. Entire paper.

Czuczwa, J.M. et al., The Bobcock & Wilcox Company Technical Paper No. RDTPA 92–25, "Development Status of the Babcock & Wilcox Cyclone Vitrification Technology for Contaminated Soil", presented at the 85th Annual Meeting of the Air & Waste Management Association, Kansas City, MO, Jun. 21–26, 1992. Entire paper.

Farzan, H. et al., The Babcock & Wilcox Company Technical Paper No. RDTPA 93–71, "Evaluation of Reburning $NO_x$ Control and Coal Switching in a Cyclone Boiler", presented at the Engineering Foundation Conference on Coal Blending and Switching of Western Low–Sulfur Coals, Snow Bird, UT, Sep. 26–Oct. 1, 1993. Entire paper.

Farzan, H. et al., The Babcock & Wilcox Company Technical Paper No. RDTPA 95–25, "Gas Reburn Retrofit on an Industrial Cyclone Boiler", presented at the EPRI/EPA 1995 Joint Symposium on Stationary Combustion $NO_x$ Control, Kansas City, MO, May 16–19, 1995. Entire paper.

Farzan, H. et al., The Babcock & Wilcox Company Technical Paper No. RDTPA 89–18, "Pilot Evaluation of Reburning for Cyclone Boiler $NO_x$ Control", presented at EPRI/EPA Joint Symposium on Stationary Conbustion $NO_x$ Control, San Francisco, CA, Mar. 6–9, 1989.Entire paper.

Maringo, G.J. et al., The Babcock & Wilcox Company Technical Paper No. PGTP 87–20, "Feasibility of reburning for cyclone boiler $NO_x$ control", presented to Joint Symposium on Stationary Combustion $NO_x$ Control, New Orleans, LA, Mar. 23–27, 1987. Entire paper.

(List continued on next page.)

*Primary Examiner*—Mark H. Paschall
*Assistant Examiner*—Gregory A Wilson
*Attorney, Agent, or Firm*—Robert J. Edwards; Eric Marich

[57] ABSTRACT

An integrated reburn system for a cyclone-fired boiler has a reburn fuel feed nozzle through a cyclone burner into the cyclone barrel, or furnace, at a region of low-velocity fuel and air movement. The reburn fuel is injected at high velocity and mostly does not mix with the combustion fuels and gases within the cyclone barrel. The reburn fuel passes through the re-entrant throat of the cyclone into the main furnace, where it forms a reburn zone having a reducing atmosphere in which the reburn fuel reacts with combustion gases from the main combustion zone to convert $NO_x$ to $N_2$, thereby reducing the amount of $NO_x$ emissions produced by the furnace.

4 Claims, 2 Drawing Sheets

OTHER PUBLICATIONS

Farzan, H. et al., "$NO_x$ Control Using Natural Gas Reburn on an Industrial Cyclone Boiler", presented at the 22nd International Conference on Coal Utilization and Fuel Systems, Clearwater, FL, Mar. 16–19, 1997. Entire paper.

Lawn, C.J., "Principles of Combustion Engineering for Boilers", ©1987 Academic Press, Harcourt Brace Jovanovich, Publishers. pp. 459–460.

Reburning Case Studies, "Complying with Emissions Regulations". Gas Research Institute, Chicago, IL. Date unknown. Sixteen pages, including covers.

Farzan, H. et al., "Reburning Scale–Up Methodology for $NO_x$ Control From Cyclone Boilers", presented at International Joint Power Generation Conference, San Diego, Ca, Oct. 6–10, 1991. pp.1–13.

Yagiela, A.S. et al., "Update on Coal Reburning Technoloy for Reducing $NO_x$ in Cyclone Boilers", presented at the EPA/EPRI Joint Symposium on Stationary Combustion $NO_x$ Control, Washington, DC, Mar. 25–28, 1991. pp. 1–23.

Farzan, H. et al., The Babcock & Wilcox Company Technical Paper No. RDTPA 95–25, "Gas Reburn Retrofit on an Industrial Cyclone Bioler", presented at EPRI/EPA 1995 Joint Symposium on Stationary Combustion NOX Control, Kansas City, MO, May 16–19, 1995.

INTEGRATED REBURN SYSTEM FOR $NO_X$ CONTROL FROM CYCLONE-FIRED BOILERS

FIELD AND BACKGROUND OF THE INVENTION

The present invention relates generally to the field of fossil fuel cyclone-fired boilers and, in particular, to the reduction of $NO_x$ compounds produced during the combustion of such fossil fuels in the boiler.

The Clean Air Act Amendments of 1990 have created significant challenges for electric power generation utilities and other industry producers to substantially reduce both $SO_x$ and $NO_x$ emissions. The Act mandates reduction of $NO_x$ from stationary sources. The sections of the Act dealing with acid rain require utilities to use low-$NO_x$ burner technology. Other sections require the use of reasonable, available control technology to reduce $NO_x$ emissions from both utility and industry sources. The resulting impact is that by January 2000, in excess of 200,000 $MW_e$ of electricity generating capacity must be retrofitted with low-$NO_x$ systems.

The limitations imposed by the Act are particularly challenging to achieve with cyclone-fired boilers. A cyclone furnace generally consists of a cyclone burner connected to a horizontal water-cooled cylinder called the cyclone barrel. Air and crushed coal are introduced through the cyclone burner into the cyclone barrel. Larger coal particles are thrust out to the barrel walls by a cyclonic motion of combustion air where they are captured and burned in the molten slag layer that forms on the barrel walls. Smaller particles burn in suspension. The mineral matter melts and exits the cyclone via a tap at the cyclone throat which leads to a water-filed slag tank. Combustion gases and remaining ash exit the cyclone and enter the main furnace.

Currently, cyclone-fired boilers account for approximately 26,000 $MW_e$ of generating capacity in the United States, or approximately 15% of pre-New Source Performance Standards (NSPS) coal-fired generating capacity. These units contribute approximately 21% of $NO_x$ emissions produced by pre-NSPS coal-fired units.

Typical low-$NO_x$ burners and staged combustion techniques do not work in cyclones because these techniques rely on the creation of an oxygen deficient, or reducing, atmosphere to hamper the formation of $NO_x$ compounds. Creating a reducing atmosphere within a cyclone firing typical high sulfur, high iron fuels is not practical due to the corrosion of tubes which would occur and the resulting maintenance costs and problems. Cyclones firing these fuels must operate with excess oxygen in the cyclone barrel, and this condition coupled with high temperatures and severe turbulence within the cyclone barrel are the reasons why cyclone-fired boilers are disproportionately high sources of $NO_x$ emissions.

Reburn technology offers cyclone-fired boiler operators an alternative to expensive flue gas cleanup techniques for reducing $NO_x$ emissions by injecting supplemental fuel, such as oil, coal, natural gas (or other) into the main furnace to create locally reducing conditions which convert $NO_x$ produced in the main combustion zone to molecular nitrogen, thereby reducing the total amount of $NO_x$ emissions.

Several modifications to cyclones have been used to attempt to reduce $NO_x$ emissions from these boilers. Conference papers discussing these alternatives include: G. J. Maringo, et al., "Feasibility of Reburning for Cyclone Boiler $NO_x$ Control", EPA/EPRI Joint Symposium on Stationary Combustion $NO_x$ Control, New Orleans, La., Mar. 23–27, 1987; H. Farzan, et al., "Pilot Evaluation of Reburning for Cyclone Boiler $NO_x$ Control", EPA/EPRI Joint Symposium on Stationary Combustion $NO_x$ Control, San Francisco, Calif., Mar. 6–9, 1989; H. Farzan, et al., "Reburning Scale-Up Methodology for $NO_x$ Control from Cyclone Boilers", International Joint Power Generation Conference, San Diego, Calif., Oct. 6–10, 1991; A. S. Yagiela, et al., "Update On Coal Reburning Technology for Reducing $NO_x$ in Cyclone Boilers", EPA/EPRI Joint Symposium on Stationary Combustion $NO_x$ Control, Washington, DC, Mar. 25–28, 1991; H. Farzan, et al. "Evaluation of Reburning $NO_x$ Control and Coal Switching in a Cyclone Boiler", Engineering Foundation Conference on Coal Blending and Switching of Western Low Sulfur Coals, Snow Bird, Utah, Sept. 26–Oct. 1, 1993; H. Farzan, et al., "Gas Reburn Retrofit on an Industrial Cyclone Boiler", EPA/EPRI Joint Symposium on Stationary Combustion $NO_x$ Control, Kansas City, Mo., May 16–19, 1995; H. Farzan, et al., "$NO_x$ Reduction Using Natural Gas Reburn on an Industrial Cyclone Boiler", International Joint Power Generation Conference, Houston, Tex., Oct. 14–16, 1996. These papers generally discuss the problems of $NO_x$ emission reductions and some solutions are offered.

Examples of known solutions described in some of the articles for reducing $NO_x$ emissions from cyclone boilers are also shown in U.S. Pat. Nos. 5,052,312 and 5,022,329. In these patents, a cyclone furnace for burning hazardous wastes is disclosed which creates a reducing condition inside the cyclone furnace adjacent the main furnace. A burner is used to inject fuel adjacent to the end of the cyclone barrel. The fuel is directed outwardly by the burner nozzles and immediately mixes with the swirling air and fuel present in the cyclone.

A cyclone after-burner for reducing $NO_x$ is disclosed in U.S. Pat. No. 5,572,956 to Hallstrom et al. and has a retractable fuel pipe within a lance which extends through the cyclone to the re-entrant throat of the main furnace. Reburn fuel is not provided within the cyclone, but rather to a point beyond the cyclone.

SUMMARY OF THE INVENTION

The present invention takes advantage of the natural flow of cyclone furnaces to economically reduce $NO_x$ emissions from cyclone-fired boilers, as will be described herein in greater detail.

It is an object of the present invention to provide an apparatus which is economically efficient to retrofit to existing cyclone-fired boilers to improve the environmental impact of the process combustion process.

It is a further object of the present invention to modify the combustion of cyclone-fired boilers to help reduce $NO_x$ emissions to government standards. The present invention is simple to retrofit, and simple to control/operate with no adverse maintenance or cyclone operational concerns.

Accordingly, a cyclone furnace is provided in which a conventional cyclone-fired boiler having a cyclone barrel with a re-entrant throat end and a burner end is modified so that reburn fuel is injected at high velocity into an area within the cyclone barrel where the mixture moves at low velocity adjacent the burner end. The reburn fuel is provided at a point inside the cyclone barrel adjacent to the burner end; however, due to the natural aerodynamic qualities of the cyclone furnace and a high velocity injection of reburn fuel, the reburn fuel reacts only minimally with the cyclone gas mixture before being ejected out the re-entrant throat into the main furnace where reducing conditions occur.

The reducing conditions in the boiler furnace are thus enhanced through good mixing of reburn fuel and combustion gases by the simplified addition of reburn fuel through the cyclone furnace, according to the present invention.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
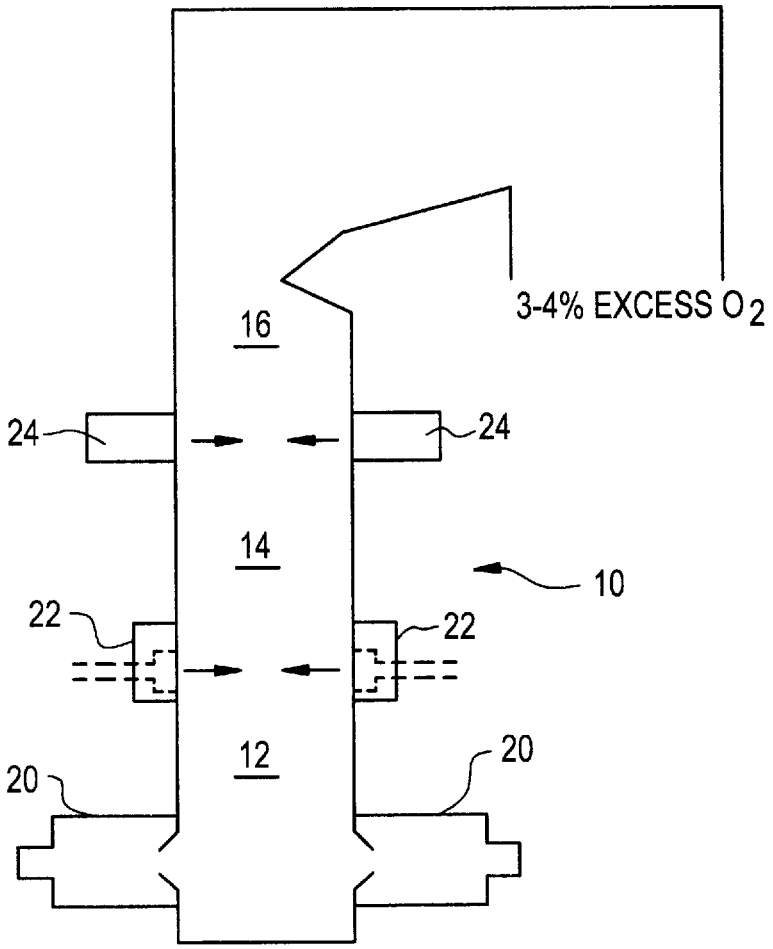
FIG. 1 is a schematic drawing of a cyclone-fired boiler using the standard reburn process.

Referring now to the drawings, FIG. 1 shows a simplified diagram of the combustion and reburn regions within a boiler furnace 10. One or more cyclones 20 are provided at the lower end of the furnace 10, where the main combustion zone 12 is located. Stoichiometry within the main combustion zone 12 is ideally 1.1 (10% excess air) and the majority of the fuel, 65% to 85%, is combusted.

Currently, reburning burners 22 inject the balance of fuel, 15% to 35%, into the furnace 10 above the main combustion zone 12. The reburn fuel is injected at the bottom of the reburn zone 14 in the furnace 10. Reburn burners 22 are operated at low stoichiometries so that oxygen deficient combustion gases will mix with combustion products from the main combustion zone 12 to obtain a reburn zone 14 stoichiometry of between about 0.85 and 0.95 in order to achieve maximum $NO_x$ reduction. A sufficient residence time within the reburn zone is required for the combustion gases to properly mix and react and thereby reduce $NO_x$ produced.

Over-fire air ports 24 inject the remaining amount of required combustion air, about 15% to 20%, at a point above the reburn burners 22. The over-fire air creates a burnout zone 16 to complete combustion of the fuels within the furnace 10. Sufficient residence time within this zone 16 is also required in order to achieve complete fuel burnout prior to the flue gases leaving the furnace 10 for heat recovery and cleaning.

Figure 2:
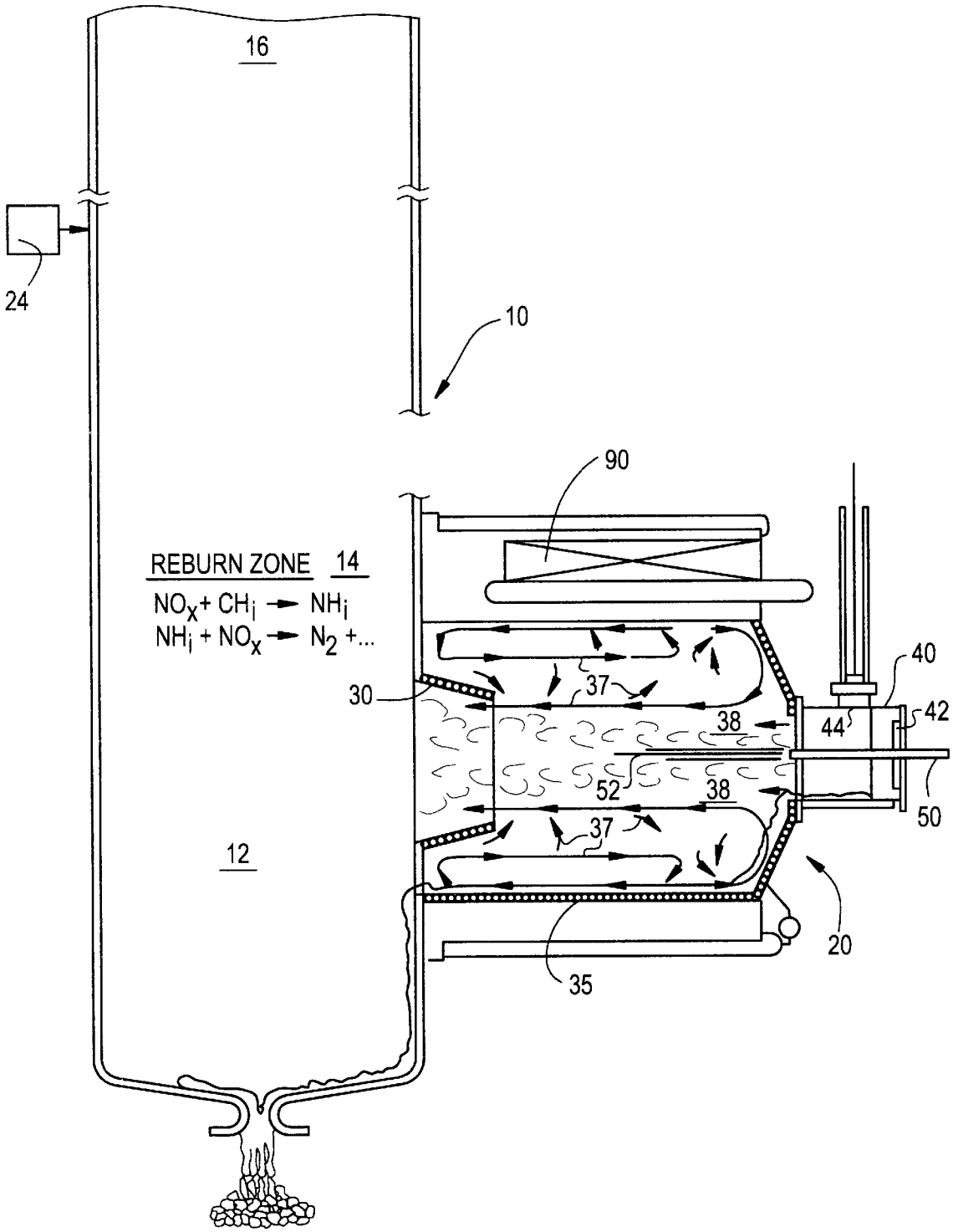
FIG. 2 is a partial sectional side view of a cyclone-fired boiler using the integrated reburn apparatus of the invention.

FIG. 2 shows how the modification of the furnace according to the invention is made to the furnace 10 described above. In FIG. 2, the furnace 10 has one or more cyclone(s) 20 located adjacent to the lower end. For clarity, only one cyclone 20 is shown. The cyclone 20 has re-entrant throat 30 communicating with the main combustion zone 12 of furnace 10 at one end of cyclone barrel 35. The other end of cyclone barrel 35 is open to accept fuel and air from burner 40. Various cyclone burner 40 types are available to introduce air and fuel to the cyclone barrel 35. Fuel and air inlet 44 and air inlet 42 can be varied based on burner 40 type. Secondary air inlet 90 is provided above cyclone barrel 35.

A reburn fuel feed nozzle 50 is provided through the center of burner 40 (independent of burner type) along a horizontal axis. Reburn fuel feed nozzle 50 extends through burner 40 to a point just inside cyclone barrel 35 adjacent to the burner 40. Reburn fuel feed nozzle 50 is used to inject reburn fuel 52 into the cyclone barrel 35 at a region 38 which has low-velocity combustion fuel and air movement.

Arrows 37 represent the cyclonic movement of the fuel and combustion gases through the cyclone 20. Low-velocity region 38 exists due to the natural aerodynamics and flows through the cyclone 20. See, for example, C. J. Lawn, "Principles of Combustion Engineering for Boilers", 1987, Academic Press., Inc., Orlando, Fla., pp. 460. The invention takes advantage of the low-velocity region 38 to inject the reburn fuel 52 at high velocity so that it passes through the cyclone barrel 35 and re-entrant throat 30 with a minimum of reaction with the other fuel and gases represented by arrows 37. Thus, the reburn fuel 52 can pass into the main furnace region and reburn zone 14, where it reacts with combustion gases, including $NO_x$, in a reducing atmosphere to form molecular nitrogen gas and thereby reduce the amount of $NO_x$ emissions produced by the boiler furnace 10.

The reburn process continues as described for FIG. 1, with over-fire air ports 24 providing over-fire air to a burnout zone 16 above the reburn zone 14.

The reburn fuel injection system of the present invention is more economical in that existing cyclone-fired boilers will require fewer components to be installed in order to take advantage of reburn technology to reduce $NO_x$ emissions. Further, it is simplified compared to conventional systems which use separate reburn fuel burners 22 that must be added to existing systems at high cost. The present invention simply requires the addition of a single reburn fuel feed nozzle 50 through the existing cyclone burner 40. This simplification can reduce the conversion of cyclone-fired boilers to incorporating reburn technology by up to 50% of current costs without increasing cyclone operational and maintenance problems.

The use of natural gas as a reburn fuel is greatly improved, although other fossil fuels can also be used. In particular, it is estimated that when natural gas is used as the reburn fuel that the amount used can be reduced to about 10 to 15% of the total fuel combusted. This improvement significantly affects the long-term operating cost, while providing beneficial environmental effects through the reduction of $NO_x$ emissions.

Reburn fuel can be supplied to the reburn fuel feed nozzle 50 using any known sources and supply means, such as pumps or pressure systems. Known valve and operating systems can be used to control the flow of reburn fuel 52 through the reburn fuel feed nozzle 50.

While a specific embodiment of the invention has been shown and described in detail to illustrate the application of the principles of the invention, it will be understood that the invention may be embodied otherwise without departing from such principles.

We claim:

1. In a cyclone-fired boiler of the type having at least one cyclone furnace adjacent to a main furnace lower end, the cyclone furnace having a re-entrant throat opening connecting the main furnace lower end with one end of a cyclone barrel, a cyclone burner connected to the other end of the cyclone barrel, and means for providing combustion fuel and air to the cyclone burner, an integrated reburn system for reducing $NO_x$ emissions from the boiler comprising:

over-fire air port means for providing over-fire air to an upper end of the main furnace to create a burnout zone;

a reburn fuel feed nozzle extending through the cyclone burner to a region of low-velocity fuel and gas movement inside the cyclone barrel end adjacent to the cyclone burner; and means for providing reburn fuel through the reburn fuel feed nozzle to the cyclone barrel.

2. The integrated reburn system according to claim 1, wherein the reburn fuel is provided to the cyclone barrel at a high velocity.

3. In combination with a cyclone-fired furnace, an integrated reburn system for a furnace for reducing $NO_x$ emissions, comprising:

a furnace, having upper and lower ends;

over-fire air port means for providing over-fire air to a burnout zone in the upper end of the furnace;

at least one cyclone furnace adjacent the furnace lower end, the cyclone furnace having a cyclone barrel connected at one end to the furnace lower end by a re-entrant throat opening and a cyclone burner connected at the other end, the cyclone burner for providing combustion fuel and air to the cyclone barrel;

means for providing combustion fuel and air to the cyclone burner; and a reburn fuel feed nozzle inserted through the cyclone burner into the cyclone barrel, an end of the reburn fuel feed nozzle positioned in a region of low-velocity movement of combustion fuel and air in the cyclone barrel adjacent to the cyclone burner, and means for providing reburn fuel to the reburn fuel feed nozzle.

4. The combination including the integrated reburn system according to claim 3, wherein the reburn fuel exists the reburn fuel feed nozzle at a high velocity.

* * * * *

UNITED STATES PATENT AND TRADEMARK OFFICE

CERTIFICATE OF CORRECTION

PATENT NO. : 5,878,700
DATED : March 9, 1999
INVENTOR(S) : Hamid Farzan and Gerald J. Maringo It is certified that error appears in the above-identified patent and that said Letters Patent is hereby corrected as shown below:

Column 6, claim 4,
Line 14, "exists" should be -- exits --

Signed and Sealed this

Fifth Day of March, 2002

*Attest:*

*Attesting Officer*

JAMES E. ROGAN
*Director of the United States Patent and Trademark Office*